US005456621A

United States Patent [19]

Gan

[11] Patent Number: 5,456,621

[45] Date of Patent: Oct. 10, 1995

[54] SELF-WIPING/SELF CLEANING ELECTRICAL CONTACT

[75] Inventor: Ginn Y. Gan, Olathe, Kans.

[73] Assignee: RELM Communications, Inc., Indianapolis, Ind.

[21] Appl. No.: 189,935

[22] Filed: Feb. 1, 1994

[51] Int. Cl.[6] ..... H01R 13/17

[52] U.S. Cl. ..... 439/700; 439/824

[58] Field of Search ..... 439/436, 700, 439/824, 482

[56] References Cited

U.S. PATENT DOCUMENTS

| | | | |
|---|---|---|---|
| 3,378,810 | 4/1968 | Dorrell | 439/436 |
| 3,458,851 | 7/1969 | Webb | 439/436 |
| 4,560,926 | 12/1985 | Cornu et al. | 439/482 |
| 4,743,201 | 5/1988 | Robinson et al. | 439/824 |
| 5,009,613 | 4/1991 | Langgard et al. | 439/824 |

FOREIGN PATENT DOCUMENTS

| | | | |
|---|---|---|---|
| 1765461 | 7/1971 | Germany | 439/482 |
| 2815330 | 10/1979 | Germany | 439/824 |
| 700936 | 11/1979 | U.S.S.R. | 439/824 |
| 2277414 | 10/1994 | United Kingdom | 439/700 |

*Primary Examiner*—Gary F. Paumen
*Attorney, Agent, or Firm*—Banner & Allegretti, Ltd.

[57] ABSTRACT

An electrical contact is disclosed in which a contact pin having a head portion is reciprocated relative to a contact housing between upper and lower positions. The contact housing has a cylindrical portion with two oppositely opposed diagonal slots formed in the wall of the housing. A dowel pin is inserted through the slots and connected to the lower portion of the contact pin. When the contact pin is pushed to its lower position, as by placement of a corresponding contact on the contact pin, the dowel pin slides down the slots, including rotation in the contact pin about its axis. The rotation causes the contact pin head portion to be wiped against the corresponding contact, cleaning the head portion and preventing the build-up of undesirable oxides, dirt or other debris on the surface of the head portion.

11 Claims, 4 Drawing Sheets

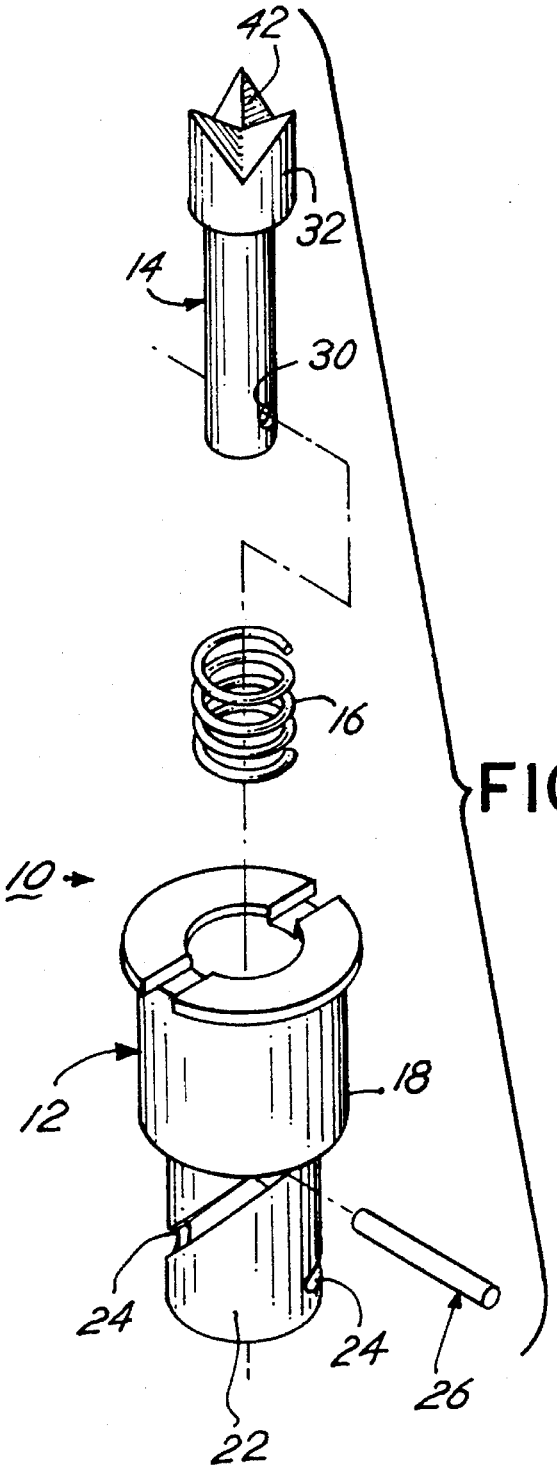
FIG.1
FIG. 3
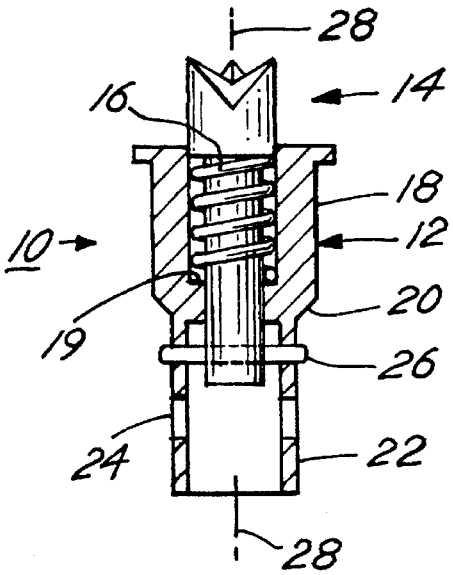
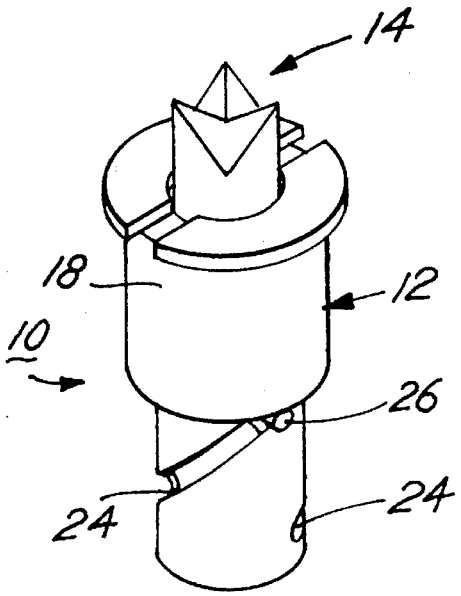
FIG.2

FIG. 9
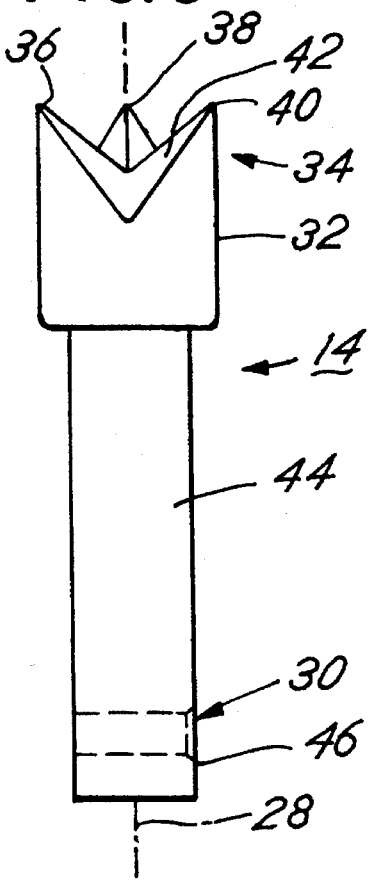
FIG. 10
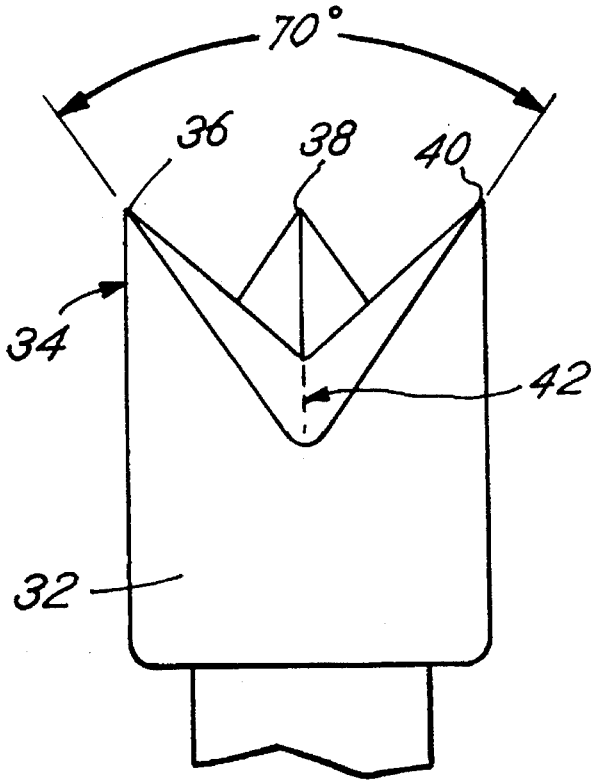
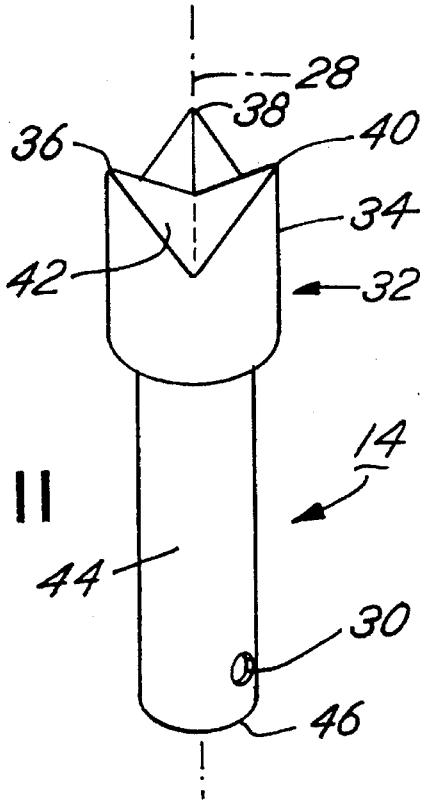
FIG. 11

SELF-WIPING/SELF CLEANING ELECTRICAL CONTACT

BACKGROUND OF THE INVENTION

1. Field of the Invention

This invention relates to the field of electrical contacts used in electrical apparatus. More particularly, the invention relates to a self-cleaning electrical contact which prevents oxides, dirt and other undesirable substances from building up on the surface of the contact.

2. Description of Related Art

Electrical contacts are used in a wide variety of applications. One example is in a battery charger, where the electrical contact is electrically connected to a voltage source and is the point of contact between the voltage source and a battery pack. Electrical contacts for battery chargers, particularly those used in field operations, tend to be exposed to the outside environment for long periods of time. As a consequence, layers of oxides, dust, and dirt can build up on the surface of the contact. If the contacts are not cleaned regularly, or the contaminants are not otherwise removed regularly, they can build up to form a layer of insulation, providing a high resistance to current flow. The build up of oxides and debris often results in a poor or or ineffective contact between the electrical contact of the battery charger and the electrical contacts of the battery packs. This in turn causes a high percentage of ineffective charging of the battery packs. Since the battery packs are susceptible to poor charging, the performance of the entire system based on the battery packs is reduced. When the system relying on the battery pack is a mobile communications system such as a hand-held portable radio system, the need for reliable charging of the battery packs becomes an import performance issue.

Prior electrical contacts used in battery chargers for hand-held radios have used single point contacts. The contacts are prone to build up of oxides and dirt unless regularly cleaned. There has been a long-felt need for an electrical contact which resists the build up of oxides and dirt, and for an electrical contact which has a self-cleaning ability.

This invention solves that need by providing a novel and advantageous electrical contact which has self-wiping and self-cleaning characteristics, whereby the electrical contact is cleaned of oxides and dirt every time it is used. The electrical contact of this invention results in more reliable performance of the battery charger or other apparatus that uses the inventive electrical contact.

Accordingly, an object of the invention is to provide an electrical contact which has a self-cleaning ability to prevent undesirable oxides and dirt from building up. A related object of the invention is to ensure that a good, reliable electrical connection is made between the electrical apparatus using the inventive electrical contact.

Another object of the invention is to provide an improved battery charger arrangement whereby a battery pack is reliably charged using the inventive electrical contact due to the electrical contact's self-wiping and self-cleaning characteristics.

SUMMARY OF THE INVENTION

These and other objects and features of the invention are provided by an electrical contact comprising a cylindrical housing and a contact pin having a head portion nested within the cylindrical housing. The contact pin is reciprocable relative to the housing between upper and lower positions. A guide means cooperating with the cylindrical housing and the contact pin is further provided for rotating the contact pin relative to the housing when the contact pin is reciprocated between the upper and lower positions. A spring is provided for biasing the contact pin to the upper position. When the corresponding electrical contact (e.g., the contact of the battery pack) seats on the head of the contact pin, the contact pin is moved to its lower position and simultaneously rotated about its axis to cause a wiping action between the contact pin and the corresponding electrical contact. The frictional wiping action between the two contacts causes the contact pin to be cleaned of oxides, dirt and other debris, resulting in reliable connection between the contacts.

BRIEF DESCRIPTION OF THE DRAWINGS

The presently preferred embodiment of the invention is illustrated in the appended drawings, wherein like reference numerals refer to like elements in the various views, and wherein:

FIG. 1 is an exploded, perspective view of a preferred electrical contact;

FIG. 2 is a perspective view of the electrical contact of FIG. 1 in an assembled condition;

FIG. 3 is a vertical, cross-sectional view of the electrical contact of FIG. 2;

FIG. 9 is an isolated, side elevational view of the contact pin of FIG. 1–3;

FIG. 10 is an enlarged elevational view of the head portion of the contact pin of FIG. 9;

FIG. 11 is a perspective view of a the contact pin of FIG. 9; and

DETAILED DESCRIPTION OF THE PREFERRED EMBODIMENT OF THIS INVENTION

Figure 4:
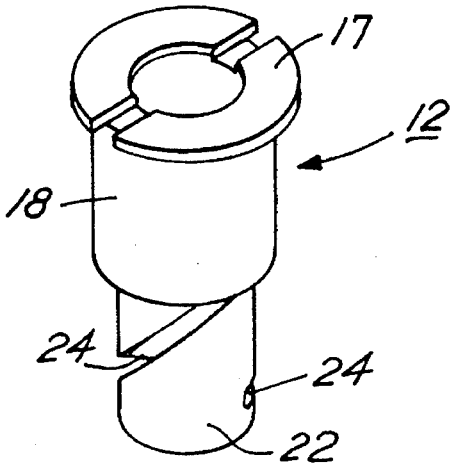
FIG. 4 is an isolated, perspective view of the contact housing of FIGS. 1–3.
Figure 6:
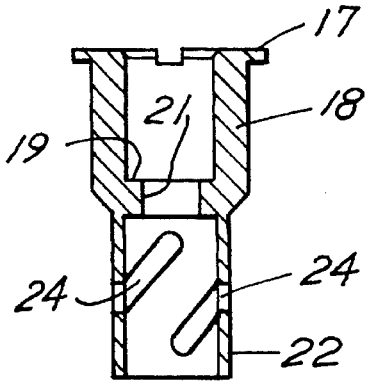
FIG. 6 is a vertical, cross-sectional view of the contact housing of FIG. 4 along the line 6—6.
Figure 5:
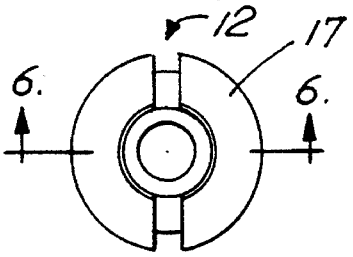
FIG. 5 is a top plan view of the contact housing of FIG. 4.

Referring to FIGS. 1–3, the preferred embodiment of the electrical contact 10 of the present invention has a brass contact housing 12, a brass contact pin 14 and a compression spring 16 which biases or restores the contact pin 14 to an upper position as shown in FIGS. 2 and 3 after the contact pin 14 has been pushed to a lower position. The contact pin 14 goes through the spring 16 and rests such that the head portion 32 of the contact pin 14 rests on the upper portion of the spring 16.

Figure 8:
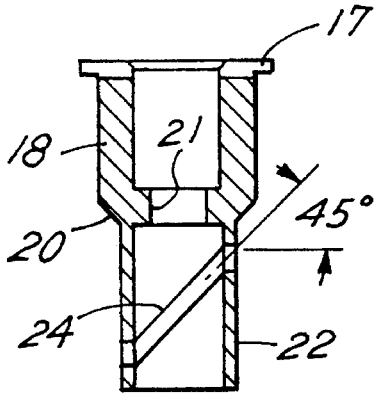
FIG. 8 is a vertical cross-sectional view of the contact housing of FIG. 7 along the line 8—8.

Referring to FIGS. 1–3 and 4–8, the contact housing 12 has an upper portion 18 which houses the spring 16 and the contact pin 14. The middle portion 22 of the contact housing 12 defines a small through-hole 21. The middle portion 22 also provides a shelf 19 which acts as a stop to hold the spring 16 and prevent the contact pin 14 and spring 16 from falling through the through-hole 21. The cylindrical lower portion 22 of the housing 12 is a thin wall tube which has oppositely-opposed slots 24 diagonally formed therein. As best seen in FIG. 8, the slots 24 are formed at a 45 ®angle and are faced directly on opposite sides of the lower portion 22.

A dowel pin 26 is press-fit into the through-shaft 30 in the lower portion of the contact pin 14. The pin 26 is installed through the slots 24 and through the contact pin 14. The pin 26, in cooperation with the slots 24 and contact pin 14, acts as a follower that slides down the slots 24 as the contact pin 14 is moved from the upper position to the lower position. The curving of the slots 24 about the lower portion 22 of the contact housing thus serves to induce approximately 360 of rotation in the contact pin about the contact pin axis 28 when the contact pin 14 is moved from the upper position to the lower position. This rotation causes the contact pin head 32 to be wiped against the corresponding contact, creating a self-wiping and self-cleaning electrical contact.

Figure 7:
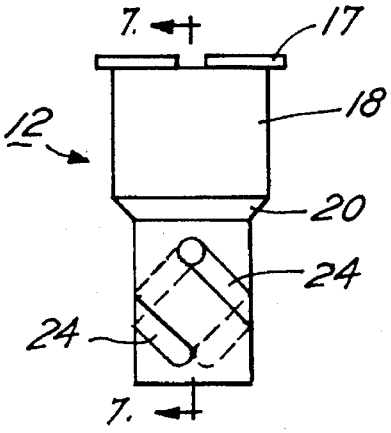
FIG. 7 is a side elevational view of the contact housing of FIG. 4.

Referring now to FIGS. 4–8, the contact hosing 12 is shown isolated in several views to show the preferred structure of the contact housing 12. Note that the upper portion 18 has an upper flange 17 which may be used to securely connect the contact housing 12 to the corresponding contact, such as the contact of a battery pack (not shown). Referring particularly to FIGS. 7 and 8, the slots 24 are shown as being formed at a 45° angle in the side of the lower portion 22 of the contact housing 12.

Referring now to FIGS. 9–11, the contact pin 14 of FIG. 1 defines an axis 28 and has a head portion 32 including a cylindrical crown portion 34 having three sharp points 36, 38 and 40 spaced equidistantly from the axis 28 and from each other. The points 36, 38 and 40 are separated by cleavages or saddles 42. The three points 36, 38, 40 make a three point electrical contact with the corresponding electrical contact (not shown). The points 36, 38, 40 and the adjacent edges are wiped against the corresponding contact as the pin is rotated about its axis 28, cleaning the crown portion 34 of oxides and dirt every time the corresponding contact is placed on the contact pin 14. The particular geometry of the cleavages 42 and points 36, 38, 40 may be modified from that shown in FIGS. 9–11. For example, a greater or lesser number of points 36, 38, 40 may be incorporated into the head 34 of the contact pin 14.

The contact pin 14 has a body portion 44 and a lower end 46. The through-shaft 30 for receiving the dowel pin 26 of FIG. 1 has a chamfered opening, as best seen in FIG. 9.

Figure 12:
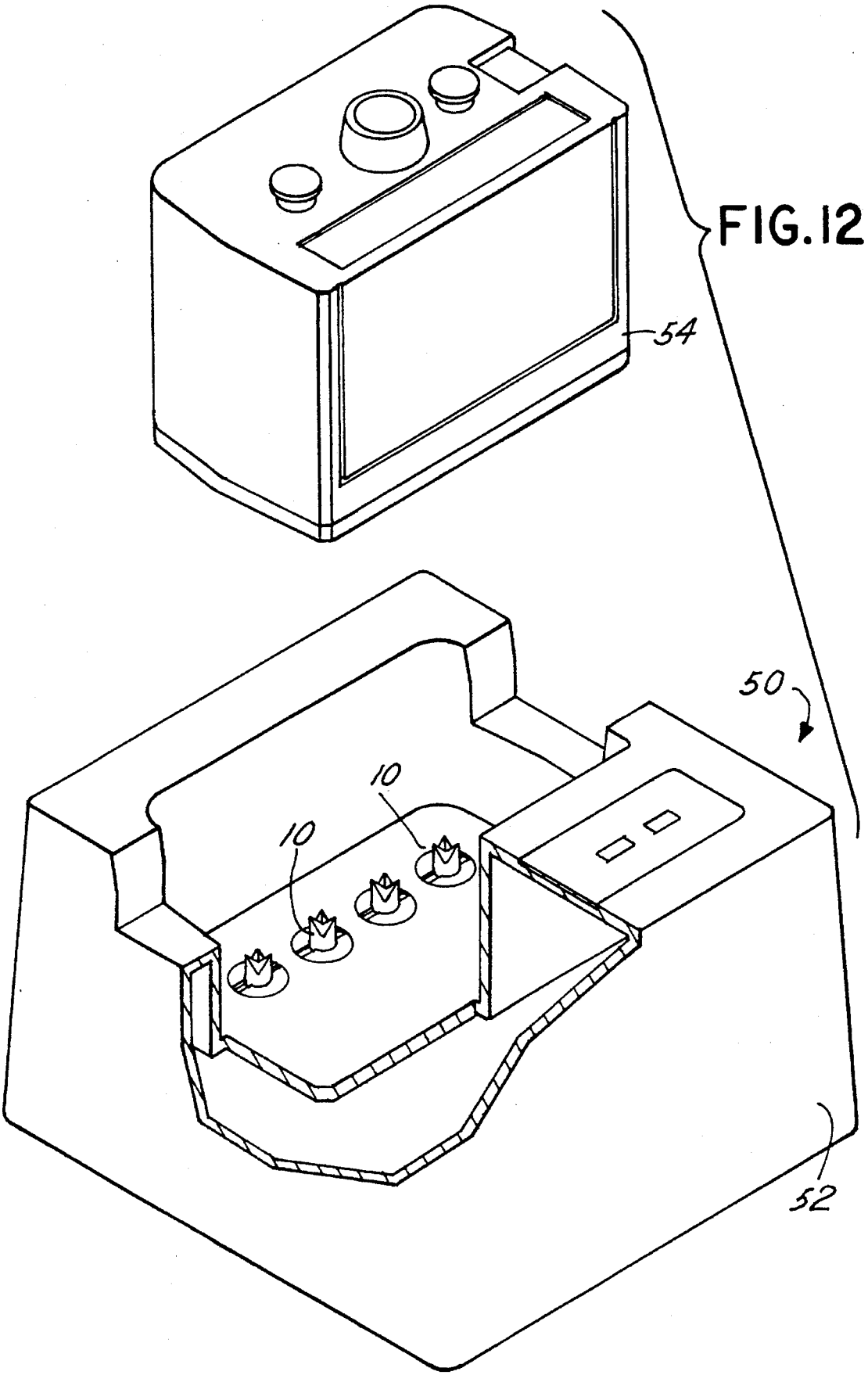
FIG. 12 is a perspective view of a battery charger having the electrical contacts of FIGS. 1–3 receiving a battery pack for recharging.

A preferred application of the electrical contact of FIGS. 1–3 is shown in FIG. 12 in which a set of contacts 10 are placed in a battery charger unit 50. The battery charger 50 has a housing 52 which incorporates a voltage source in conventional fashion. The contact pin 14 is connected to the voltage source in a conventional fashion. A battery pack 54 (for example, a battery pack for a mobile telephone or radio set) has a set of corresponding contacts such that when the battery pack 54 is inserted into the housing 52, the corresponding contacts (not shown) and the electrical contacts 10 meet. The weight of the battery pack 54 and corresponding contacts on the contact pin 14 causes the contact pin 14 to travel vertically down to its lower position against the force of the compression spring 16. The slots 24 on the contact housing 12 act as a guide track to guide the pin and to induce rotation in the pin 14 as the contact pin 14 travels down.

The process of rotating causes a wiping action between the head portion 32 of the contact 10 and the contact surface of the corresponding contact. This wiping action cleans the terminals every time the battery pack 54 is placed in the housing 52. The three-point contact pin 14 provides more points of contact than the prior art single point contact, and with the three wide cleavages 42, has a self-cleaning ability to maintain a clean contact at all times. Thus, the reliable charging of the battery pack is accomplished, improving the performance of the mobile radio or other system served by the battery charger 50.

While the foregoing description refers to a battery charging system for a mobile radio system, it will be appreciated by persons skilled in the art that the electrical contact described herein has uses in other applications. Various test components or equipment such as a PC board test pin, an electrical contact pin, or any other test equipment that uses contact pins may incorporate the teaching of this invention. Various modifications to the disclosed preferred embodiment may be made without departure from the true spirit and scope of the invention. For example, other contact pin crown designs may prove suitable. Greater or lesser amounts of rotation may be incorporated into the contact by varying the length or angle of the slots 24. The true spirit and scope of the invention is defined by the claims, interpreted in light of the specification.

I claim:

1. An electrical contact apparatus comprising:

(a) a cylindrical housing;

(b) a contact pin having a head portion, said contact pin reciprocable relative to said housing between upper and lower positions;

(c) guide means cooperating with said cylindrical housing and said contact pin for rotating said contact pin relative to said housing as said contact pin is reciprocated between said upper and lower positions, said guide means comprising:

(i) a pair of slots diagonally formed in said housing; and (ii) a pin extending through said slots connecting said contact pin to said housing; and (d) biasing means for biasing said contact means to said upper position.

2. The electrical contact apparatus of claim 2 wherein said contact pin defines a contact pin axis and further comprises a head portion, said head portion comprising two or more points equidistantly spaced relative to said pin axis, said points separated by at least one saddle region.

3. The electrical contact apparatus of claim 2 wherein said slots oppose each other.

4. An electrical contact comprising:

(a) a contact housing, said housing comprising an elongate hollow body member having an upper portion and a cylindrical lower portion, said lower portion having two oppositely-opposed slots diagonally formed therein;

(b) a contact pin having a contact pin axis nested within said upper portion of said contact housing, said contact pin having a head portion, said head portion comprising two or more points separated by at least one saddle region, said contact pin reciprocable relative to said contact housing between an upper position and a lower position;

(c) biasing means biasing said contact pin to said upper position; and (d) pin means cooperating with said oppositely-opposed slots for slidably connecting said contact pin to said housing such that said contact pin rotates about said contact pin axis as said contact pin is reciprocated between said upper position and said lower position.

5. The electrical contact apparatus of claim 4 wherein said head portion of said contact pin comprises a cylindrical crown having three points equidistantly spaced about said contact pin axis.

6. The electrical contact apparatus of claim 4 wherein said contact pin further comprises a body portion integral with said head portion, said body portion having a lower end receiving said pin means.

7. The electrical contact apparatus of claim 6 wherein said pin means comprises a pin extending through said oppositely-opposed slots and said lower end of said contact pin.

8. A battery charger comprising:

a housing, at least one electrical contact installed within said housing, comprising:

(a) a contact housing, said housing comprising an elongate hollow body member having an upper portion and a cylindrical lower portion, said lower portion having two oppositely-opposed slots diagonally formed therein;

(b) a contact pin having a contact pin axis nested within said upper portion of said contact housing, said contact pin having a head portion, said head portion comprising two or more points separated by at least one saddle region, said contact pin reciprocable relative to said contact housing between an upper position and a lower position;

(c) biasing means biasing said contact pin to said upper position; and (d) pin means cooperating with said oppositely-opposed slots for slidably connecting said contact pin to said housing such that said contact pin rotates about said contact pin axis when said contact pin is reciprocated between said upper position and said lower position.

9. Apparatus comprising:

a battery pack having a first electrical contact;

a battery charger for charging said battery pack;

a second electrical contact housed within said battery charger comprising:

(a) a cylindrical housing;

(b) a contact pin having a head portion, said contact pin reciprocable relative to said housing between upper and lower positions;

(c) guide means for rotating said contact pin relative to said housing when said contact pin is reciprocated between said upper and lower positions, said guide means comprising:

(i) a pair of slots diagonally formed in said housing; and (ii) a pin extending through said slots connecting said contact pin to said housing; and (d) biasing means for biasing said contact to said upper position; whereby placement of said first contact of said battery charger onto said second electrical contact causes said contact pin to rotatably reciprocate relative to said cylindrical housing to said lower position, causing said contact pin to be cleaned.

10. The apparatus of claim 9 wherein said contact pin defines a contact pin axis and further comprises a head portion, said head portion comprising two or more points separated by at least one saddle region.

11. The apparatus of claim 10 wherein said slots oppose each other.

* * * * *